US005484207A

United States Patent [19]

Schnaars et al.

[11] Patent Number: 5,484,207

[45] Date of Patent: Jan. 16, 1996

[54] DISCHARGE OUTLET FOR A BULK BAG UTILIZING A SIDE ENTRY RELEASE

[76] Inventors: Daniel R. Schnaars, 204 "A" St.; Jean-André Beard, 215 St. Benjamin Dr., both of Lafayette, La. 70506

[21] Appl. No.: 282,071

[22] Filed: Jul. 28, 1994

[51] Int. Cl.[6] ..... B65D 33/28; B65D 33/36

[52] U.S. Cl. ..... 383/67; 383/73; 383/75

[58] Field of Search ..... 383/67, 72, 75, 383/73, 121

[56] References Cited

U.S. PATENT DOCUMENTS

| | | | |
|---|---|---|---|
| 4,211,266 | 7/1980 | Massey | 383/67 X |
| 4,691,371 | 9/1987 | Derby | 383/67 X |
| 4,811,419 | 3/1989 | Derby | 383/121 X |
| 4,953,987 | 9/1990 | Schnaars | 383/75 X |
| 5,340,218 | 8/1994 | Cuthbertson | 383/67 |

FOREIGN PATENT DOCUMENTS

| | | | |
|---|---|---|---|
| 404044958 | 2/1992 | Japan | 383/67 |

*Primary Examiner*—Allan N. Shoap
*Assistant Examiner*—Jes F. Pascua

[57] ABSTRACT

A bulk material transport bag of the type having four walls, a top portion with the top portion including a bulk inlet spout, and a bottom, with the bottom portion including a discharge port. The bag would incorporate a cone to flat bottom feature on the bottom of the bag, which would allow the bottom of the bag to form a conical configuration when bulk material is pouring from the discharge spout, but when the discharge spout is closed off, the material of the bottom is pulled inwardly by the closure of the spout and the cone would form from the conical shape to the flat shape. When the discharge end is opened, the flat bottom of the bag would return to the conical shape serving as a discharge bottom of the bag. There would further be included a drawstring formed in a pocket around the closure so that a pulling of the drawstring would tighten the closure to form the closed end of the bag. The ends of the drawstring would be housed within a channel formed within the bottom of the bag which would allow the ends of the drawstring to be threaded through the channel and would extend out to the side of the bag rather than beneath the bag. Further, there would be provided a means for tying the drawstring of the closed end of the bag, in either a bow-tie utilizing a loop for fully disengaging the bow-tie, or a modified bow-tie utilizing a half-hitch knot to provide a means for fully disengaging the bow-tie.

16 Claims, 9 Drawing Sheets

DISCHARGE OUTLET FOR A BULK BAG UTILIZING A SIDE ENTRY RELEASE

BACKGROUND OF THE INVENTION

1. Field of the Invention

The present invention relates to bulk material transport bags. More particularly, the present invention relates to a bulk material transport bag with an improved discharge outlet which enables bulk material contained in the bag to be released by activating the downspout from the side of the bag rather than the underside of the bag.

2. General Background

Bulk material transport bags are quite common in the art, and normally such a bag would have an discharge spout extending from the bottom of the bag which is used to release the dry bulk product within the bag following transport. Every large bulk bag manufacturer including companies such as Super Sack Manufacturing Corp., Langston Companies, Stone Container, Augusta Bag, Chase Packaging Corporation, and Bulklift International, and the present applicant Flexcon and Systems, Inc. manufacture and sell bags which would have a cylindrical or a square discharge spout extending from the bottom of the bag which would normally be tied off and stuffed into the bag. Further there would be included a secondary flap or iris closure around the bottom of the bag to help protect the discharge tube during transport of the bulk material.

When this type of bag reaches its destination, the discharge flap or iris closure is opened, the discharge tube is pulled from the bag and it is untied allowing the bulk material to flow through the tube into the container to be utilized at the end of its destination. This type of closure is quite common in the art, and is very useful. However, there are some shortcomings to the closure in that an individual or the like must risk standing beneath a bag of bulk material which might weight one to two tons, and attempt to open the closure tube and yet at the same time avoid the bulk material from pouring out of the tube and perhaps injuring the worker. Worse yet, simply being under such a bag were a lifting loop or the like to fail, may have a catastrophic consequence for the person beneath the bag.

Therefore, it would be an improvement in the art of discharge spouts for bulk material transport bags, to incorporate a means for releasing the bottom discharge end of the bag without a worker or the like having to stand beneath the bag in order to accomplish this. Further, it would be beneficial if in fact the bag did not require a discharge spout, but simply allowed the worker to release a tie from the discharge opening in the bottom of the bag allowing the material to flow therefrom.

SUMMARY OF THE PRESENT INVENTION

The apparatus of the present invention solves the shortcomings in the art in a simple and straightforward manner. What is provided is a bulk material transport bag of the type having four walls, a top portion with the top portion including a bulk inlet spout, and a bottom, with the bottom portion including a discharge port. A principal embodiment of the bag would incorporate a feature on the bottom of the bag, which would allow the bottom of the bag to assume a substantially flat position when closed and filled with material, yet to form a conical configuration when bulk material is pouring from the discharge spout. When the discharge spout is closed off, the material of the bottom is pulled inwardly by the closure of the spout and the cone would return from the conical shape to the flat shape or a slightly rounded bottom. Therefore, when the discharge end is opened, the flat bottom of the bag would return to the conical shape serving as a discharge bottom of the bag. There would further be included a drawstring formed in a pocket around the closure so that a pulling of the drawstring would tighten the closure to form the closed end of the bag. The ends of the drawstring would be housed within a channel formed within the bottom of the bag which would allow the ends of the drawstring to be threaded through the channel and would extend out to the side of the bag rather than beneath the bag.

In a second embodiment, particularly suited to bulk material which would not have a tendency to "bridge" the opening, such as pellets or the like, there would be a flat bottom to the bag, which would include a downspout extending therefrom. The downspout would be tied off with a string which would then extend through the channel and would extend out to the side of the bag as with the first embodiment. There would be included a flap member on the outer surface of the bottom of the bag being of a width and length to cover the downspout that has been closed and pushed up against the flat bottom of the bag. The flap would be held in place by sewing one end of the flap and velcroing the second end across the bag closure. Therefore when bulk material is in the bag the tied downspout would prevent bulk material from exiting the bag, and the flap would prevent any inadvertent snagging. When the drawstring was pulled and the closure opened, the flap would give under the weight of the bulk and the bulk material and the material would flow from the bag.

In both embodiments the drawstring would be tied off by a bow tie knot, including a third half-hitch, so that the weight of the material would not prevent the untying of the bow tie knot when the downspout of conical bottom is opened.

A third embodiment of the apparatus would be designed to facilitate a side entry release system for a flat bottom bag having both a closure spout and a discharge spout on the bag. The closure spout would involve a modified three-eared bow tie closure, the end of which would be through a side entry channel for releasing the tie on the side portion of the bag. Further, there would be included a discharge spout having a closure tie formed in a modified bow tie within a loop, the end of which also would be threaded through the channel for side entry release. Upon first pulling the release tie for the closure spout, the tie line would be completely pulled out of the closure spout channel, to effect a complete opening of the spout. Once the closure spout has been fully opened, the second discharge spout tie would be pulled, to release the tie of the discharge spout and full release of the contents of the bag.

Therefore, it is the principal object of the present invention to provide a bulk material transport bag having a cone to flat bottom wall, which would serve as a discharge with the bottom serving as a discharge spout in the conical configuration;

It is a further principal object of the present invention to provide a bulk material transport bag having a conical bottom which eliminates the problem of "bridging" across the discharge opening when the contents of the bag are released therefrom;

It is a further object of the present invention to provide a bulk material transport bag, in one embodiment, which eliminates the requirement for a discharge spout extending from the bottom of the discharge opening of the bag;

It is a further object of the present invention to provide an improved bulk material transport bag which upon closure of the discharge spout would form a flat bottom of the bag, and upon opening of the discharge spout would form a conically shaped discharge flow portion of the bag;

It is a further object of the present invention to provide an improved bulk material transport bag having the discharge opening closed with the drawstring housed within a channel so that the drawstring may be pulled from the side of the bag to effect the discharge opening and prevent the need for reaching beneath the bag in order to accomplish same;

It is a further object of the present invention to provide a bag which prevents the premature and accidental opening of the bag due to the tie cord being snagged and pulled during handling;

It is a further object of the present invention to provide a bulk bag which incorporates a down spout closed off with a modified bow-tie knot configuration as part of a side entry release system of bulk material contained therein; and It is a further object to provide a bulk bag construction wherein a downspout is incorporated into a flat bottom bag, and the downspout is tied off by a modified bow tie knot, and the drawstring housed within a channel so that the drawstring may be pulled from the side of the bag to effect the discharge opening and prevent the need for reaching beneath the bag in order to accomplish same.

It is a further object of the present invention to provide a bulk bag construction wherein a downspout is incorporated into a flat bottom bag, also incorporating a closure spout, so the discharge spout and the closure spout form close by separate lines the ends of which are pulled from the side of the bag to effect both the closure spout opening and the discharge spout opening as a side entry release mechanism.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
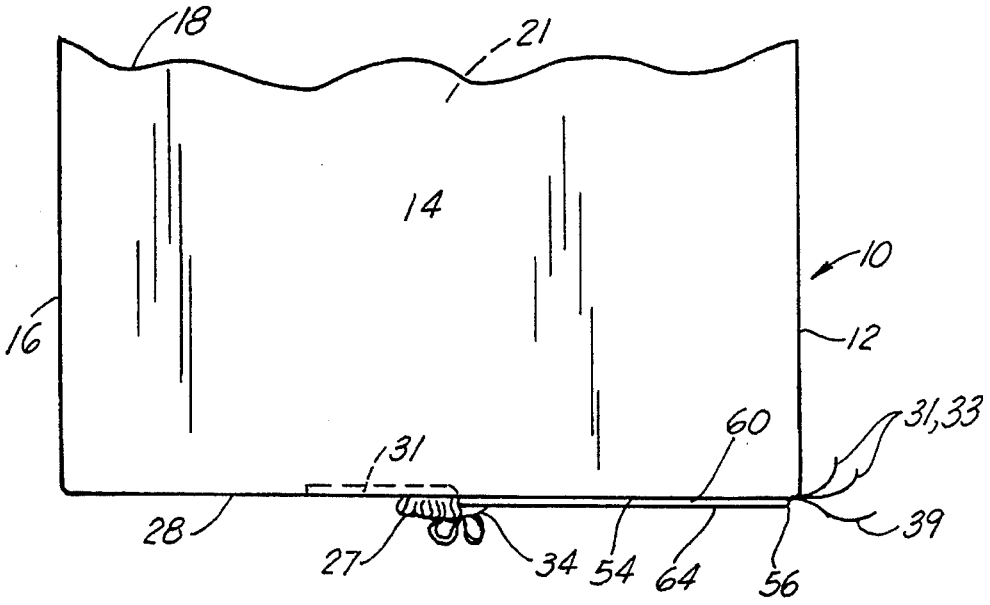
FIG. 1 illustrates a partial cross section view of the improved bulk material transport bag of the present invention filled with bulk material and fully closed with a substantially flat bottom.

FIGS. 1–4C illustrate the preferred embodiment of the apparatus of the present invention by the numeral 10. As illustrated more particularly in FIGS. 1 and 2, the improved bulk material bag 10 of the present invention, includes a plurality of side walls 12, 14, 16, 18, a top portion (not illustrated), and a bottom discharge portion 20, all defining a bulk storage space 21 that will be described more fully.

For a proper description of the side entry release system of the present invention reference will first be made to FIG. 1, illustrating the bag 10 in the fully closed position, filled with material, and, FIG. 2, in cross sectional view with the discharge portion 20 of bag 10 in the open position. A detailed explanation of the side entry release system will be discussed following an overall discussion of the bag, itself when it has been open to release material therefrom.

Figure 2:
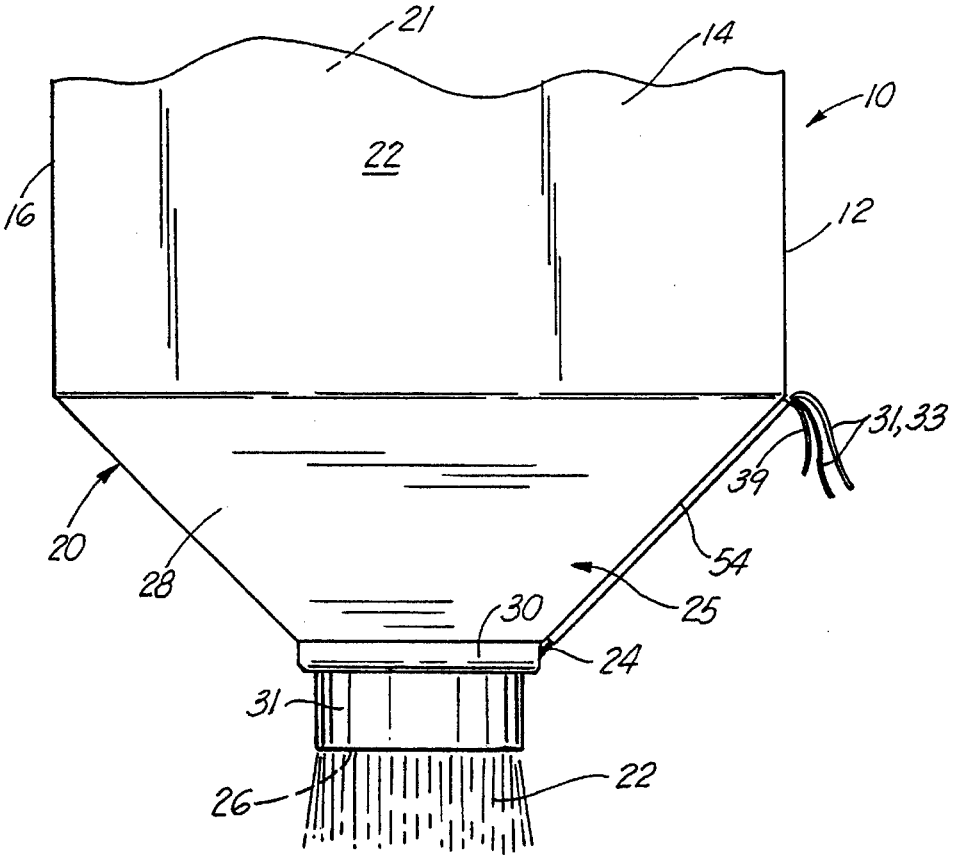
FIG. 2 illustrates an overall partial perspective view of the improved bulk material transport bag of the present invention in the open position releasing material out from the downspout of the bag.

As seen in FIG. 2 there is illustrated dry bulk material 22 contained within the bulk storage space 21 of bag 10, while the bulk bag is in the opened configuration. It is in this configuration that a drawstring 24 of the side entry release system has been pulled to release the discharge portion 20 so that there is formed a discharge opening 26 from the bottom of the bag 10, from which dry bulk 22 flows.

It should be noted in FIG. 2 that the discharge opening 26 is formed by a continuous bottom wall 28 which is formed in the "conical" configuration 25 when bulk material 22 is pouring therefrom as seen in FIG. 1. The conical configuration 25 is the result of a design of the bottom wall of the bag known as a cone to flat bottom wall, and operates principally in the manner that is described in applicant's U.S. Pat. No. 4,953,987 entitled "Cone Top to Flat Top Fabric Transport Bag", incorporated herein by reference thereto. In that design, generally when the discharge opening 26 is open, the material 22 within the bag 10 flows from the bag, and the bottom wall 28 of the bag is in the shape of a cone configuration 25 to enhance the movement of the material 22 through opening 26. However, when the opening 26 is closed off, as will be explained in detail later, the bag bottom 20 returns to a flat configuration as illustrated in FIG. 3.

Figure 3:
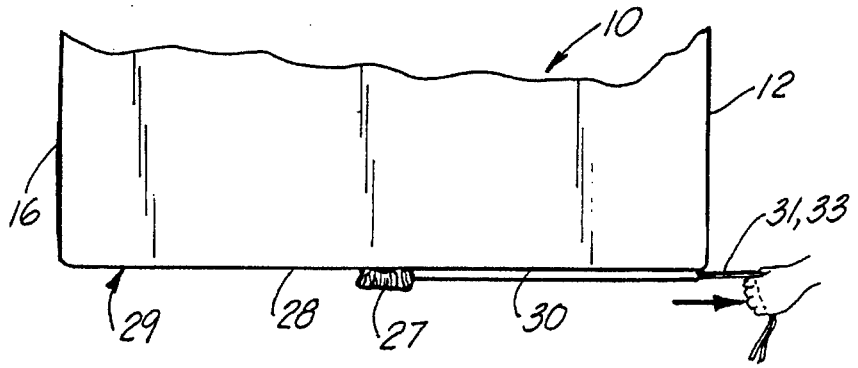
FIG. 3 illustrates a side view of the side entry release being activated to open the downspout of a fully filled bag.

What will be explained is the manner in which the bulk bag 10 construction which allows for bulk material 22 to pour from the conically configured bottom 25, through the discharge opening 26, and return to the flat configuration 29 as illustrated in FIG. 3, thus referred to as the "cone to flat" configuration. As illustrated in FIG. 1, a drawstring 24 is housed within a channel 30 formed around the outer wall of discharge opening 26. The channel 30 could be formed by either a folding over of the fabric forming the bottom of the bag and stitched in order to form the continuous channel 30, or by stitching a piece of fabric along the bottom to form the channel 30. Once the channel is formed, the drawstring 24 is housed within the channel 30, and there is no bulk material 22 within the bag, the drawstring 24 is pulled taut, and the opening 26 is then moved inwardly to form the iris closure 27 as seen in FIG. 3. However, as illustrated, there is shortened skirt 31 of fabric, which serves as a guide for the material exiting the conical end 25 of the bag during discharge. It should be noted that fabric skirt 31 has no closure string or the like, but could simply be stuffed up into the bag space 21, and the opening 26 would then be pulled closed, resulting in the configuration shown in FIG. 1. In this particular invention, when the iris closure 27 is formed, the material forming the cone bottom 25 of the bag is pulled inwardly towards the center, and thus the cone 25 moves from the conical configuration as seen in FIG. 2 to the flat configuration as illustrated in FIG. 1. It is in the configuration in FIG. 2 that the iris closure 27 is formed and that the bulk material 22 would then be poured into the bag.

It should be noted however, that once the drawstring 24 is pulled into the closed configuration as shown in FIG. 1, the drawstring 24 would be preferably tied in a "bow tie" 34 closure, which has been found to be the easiest knot which can be released when the drawstring 24 is pulled in order to open the bag, and release the contents therefrom. FIGS. 3 and 4A through 4C illustrate the process involved in opening the conical end 25 of the bag to release the materials utilizing the side entry release system.

As was illustrated in FIGS. 1 and 2, it is clear that when the end wall 28 moves from the flat configuration 29 in FIG. 1 to the conical discharge configuration in FIG. 2, that this is accomplished by a release system. Reference is now made to the FIGURES which would illustrate the side entry release means for enabling a worker or the like to safely open the discharge opening 26 into the configuration as seen in FIG. 2 without having to risk going beneath the bag in order to do so. This means would include a second fabric channel 54 formed along the bottom wall 20 of the bag and for example as seen in FIG. 2, side wall 12, to form an opening 56 at the distal end of the channel 54. The drawstring 24 would then be threaded through the channel 54 and extend out of the distal end 56 of the channel as illustrated in FIGS. 1 and 2. Prior to threading the drawstring 24 through the channel 54, a bow tie closure is formed in the drawstring at the position of the iris closure 27, and the remaining length of drawstring 24 is then fed through the channel 54. As seen in FIG. 1, therefore, when the end 58 of the drawstring 24 is pulled by a worker, the bow tie 34 would be released, and the flat end wall 20 as configured in FIG. 2 would then be pushed downward by the weight of the material 22 within the bulk bag which would result in the formation of the conical discharge 25 as seen in FIG. 1. At that instance, the weight of the bulk material 22 would pour from the bag as illustrated in FIG. 2.

Figure 4A:
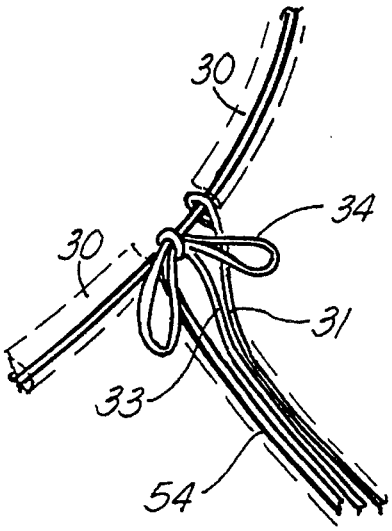
FIGS. 4A through 4C illustrate views of the system for activating the opening of the downspout of the bag from the side of the bag.
Figure 4B:
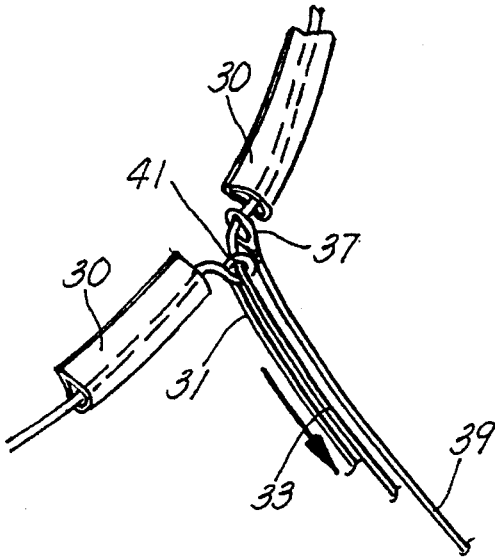
Figure 4C:
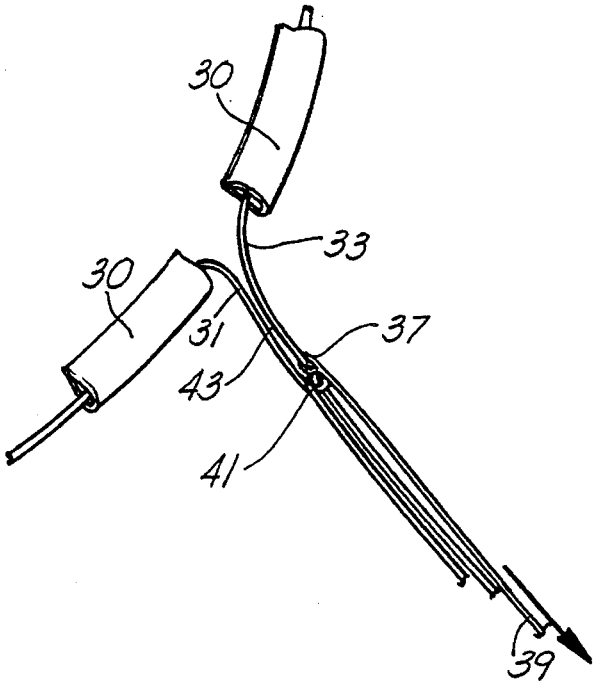

However, in some cases, due to the enormous weight of the material pressing down on the closure, release of the bow tie 34 may not necessarily result in complete opening of the closure spout to form the full conical discharge 25. Therefore, FIGS. 4A through 4C illustrate a means by which the spout will fully open although the original bow tie 34 fails to fully untie and allow the opening to form. As seen in FIG. 4A, there is illustrated the bow tie 34 formed at the end of the channel 30 around the end of the bag, with the bow-tie ends 33, 35 extending into channel 54, and exiting along the side wall 12 of the bag. When these ends are pulled, the bow-tie 34 becomes undone. However, as seen in FIGS. 4B and 4C, to assure that the bow-tie 34 is not allowed to snag, a safety loop 37 is provided between the bow-tie 34, and the end of channel 30. When the bow-tie 34 is released, the second end 39 of the safety loop 37 is pulled, and the loop 37 carries the single knot 41 of the open bow-tie down the length of the channel 54, so that the full opening of the downspout is assured. Rather than have the bow-tie 34 snag in the position as seen in FIG. 4B, the knot 41 is pulled down to the position as seen in FIG. 4C, thus allowing additional line 43 to form the fully opened spout.

Figure 4D:
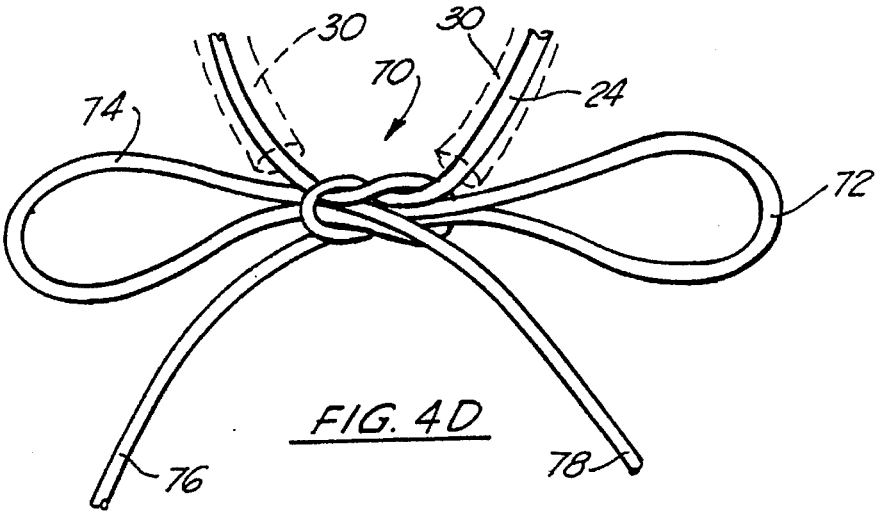
FIGS. 4D through 4F illustrate views of the system for activating the opening of the downspout of the bag from the side of the bag, utilizing a bow-tie configuration with a third "half-hitch" loop incorporated therein.
Figure 4E:
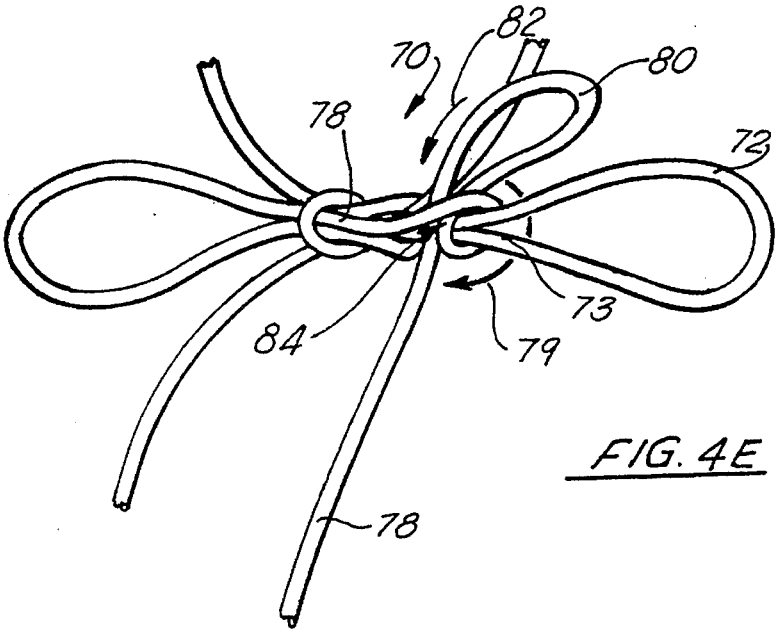
Figure 4F:
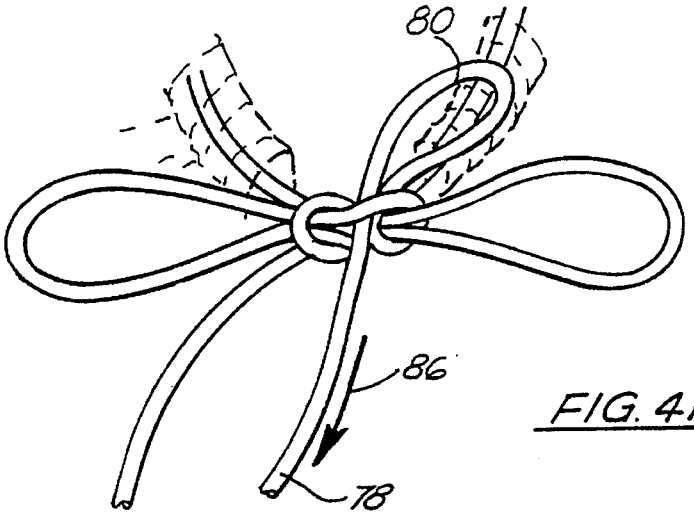

FIGS. 4D through 4F illustrate yet an additional embodiment for assuring release of the bow-tie in this particular embodiment. As illustrated in FIG. 4D, there is illustrated a typical bow-tie 70 formed from the drawstring 24, exiting channel 30, with the bow-tie 70 including a pair of looped portions 72, 74 which terminate in portions 76, 78 respectively. This is a typical bow-tie, and would be the type as was discussed earlier in FIGS. 4A through 4C. FIG. 4E would illustrate a modification of bow-tie 70, as illustrated in FIG. 4D, for assuring that bow-tie 70 would be fully released when the bow-tie loop end 78 is pulled for release of the downspout. It should be noted in this particular embodiment, that because of the unique configuration of the bow-tie as will be discussed further, there is no need to incorporate the loop 37 attached to a second string 39 as was discussed earlier, in reference to FIGS. 4A through 4C. The drawstring would not be "anchor" stitched to the fabric wall of the protective cover. This would allow the person pulling the tie from the distal end of the protective channel to pull the tie completely out. This ensures complete opening of the iris closure protective cover and allows the discharge spout to fall freely into the discharge position.

Figure 6:
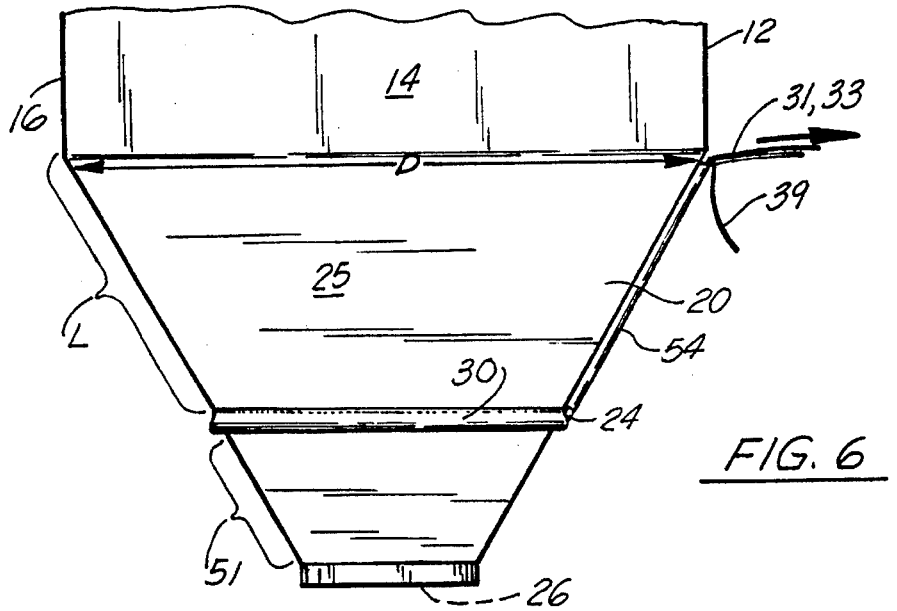

Turning now to FIG. 4E, bow-tie 70, as illustrated, wherein the end member 78 rather than hanging down in the position as seen in FIG. 4D would be wrapped around the base 73 of loop 72 in the direction of Arrow 79 and in doing so, would form a third loop 80. The end 78 would then be threaded back through in the direction of Arrow 82 between the base of strand 80 and the base of loop 73, so that the end 78 would hang in the position as seen in FIG. 4E. Therefore, there would be in effect formed a third support knot 84 around the base 73 of loop 72 which would be a "half-hitch" knot, and would take the greater weight of the material pressing down on the tied configuration. Following the tying of the bow-tie with the "third loop 80" in the configuration 4E, the end 78 would then be threaded through channel 30 as seen in FIG. 3 or channel 54 as seen in FIG. 6, and would be hanging down adjacent the side wall 12 of bulk bag 10. Therefore, when the operator wish to open the downspout, he would simply pull end 78 in the direction of Arrow 86 as seen in FIG. 4E, and the third "half-hitched" loop 80, would then be pulled free, and the bow-tie knot would be pulled free. When this half-hitch knot 80 is pulled free, then a continual pulling of string 78 would then easily free the bow-tie knot and the draw string 24 would be fully extended due to the full opening of the downspout, and the material would flow from the bag.

It should be noted that in this particular configuration, upon the full opening of the downspout, it is probable that the drawstring will be pulled into the channel 30 or channel 54, as illustrated in the FIGURES, and one would have to retrieve the drawstring therefrom following the emptying of the bag. It should be made clear that in this particular embodiment, as illustrated in FIG. 4D through 4F, this provides a means for the most convenient and easy manner in which to tie off the downspout, with the use of a modified bow-tie so as to assure that when the end 78 of drawstring 24 is pulled by the operator from the side entry release, that the bow-tie is easily untied, and that the material is allowed to flow freely.

Figure 5:
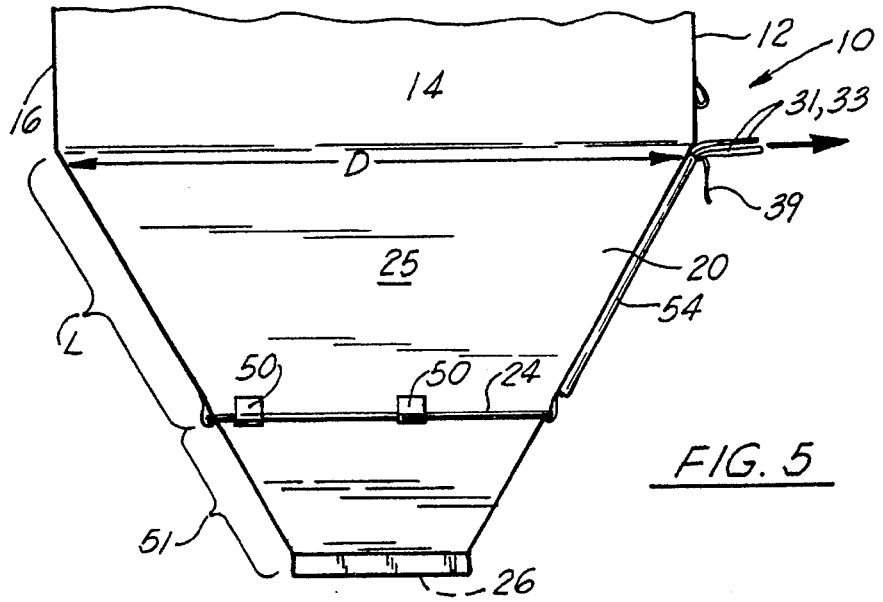
FIGS. 5 and 6 illustrate side views of alternate embodiments of the downspout configuration utilizing the side entry release system of the present invention.

FIGS. 5 and 6 illustrate additional embodiments of the configuration of the downspout in the "flat-to-cone" discharge spout using the side entry release system. As illustrated, and comparing the structure with the principal embodiment illustrated in FIG. 2, in these configurations, rather than have the drawstring channel 30 at the very end of the conical discharge 25, and then incorporate the skirt 31, as seen in FIG. 2, the skirt 31 is removed, and the drawstring channel 30 is moved up a distance of the conically shaped wall of the end 20. The distance necessary to form a substantially flat end wall 20 as in FIG. 1, when the drawstring 24 is pulled taut, is governed by the fact that the length (L) of wall 20 between the channel 30 and the end of the sidewalls of the bag must be no greater than one half the diameter (D) of the bag along its bottom width. The same rule would apply to FIG. 6, where, rather than have a continuous release channel 30, there are provided a series of spaced apart loops 50 sewn to the conical wall 27 for housing the drawstring 24 around the conical end 25 of the bag.

In both embodiments of FIGS. 5 and 6, the portion 51 of the conical end 25 below the drawstring 30 would serve the same function as the guide skirt 31 in the principal embodiment. Likewise, the side entry release system as previously described in FIGS. 3, 4A through 4C, and 4D through 4F, would apply to these two embodiments, also, and therefore will not be reiterated herein.

This type of bag construction offers several the improvements in bulk bag art. First, the bag bottom 25 of the bulk material transport bag 10 can reconfigure from the flat configuration, as illustrated in FIG. 2, when bulk material 22 is contained in the bag, to the cone shape configuration, as illustrated in FIG. 2, when bulk material 22 is pouring from the discharge end 26, therefore eliminating the need for a discharge spout as is found in the prior art.

Further, the use of the drawstring in tying closed the iris closure 27 is illustrated in FIG. 1 and moving the ends of the drawstring to the side of the bag eliminates the possibility that a worker who would pull the drawstring from the bottom of the bag. This eliminates the potential danger of a work being unable to move away in time due to the weight of the bulk material pouring from the bag once that iris opening is opened.

It should be noted that channel 54 that was described earlier would house the drawstring 24 and therefore prevent drawstring 24 from being exposed along the bottom of the bag, so that when the bag is being moved, the drawstring could not be caught up on any type of mechanism or the like which would inadvertently open the end of the bag during transport.

Further, the feature of the loop for guaranteeing full release of bow-tie 34, as seen in FIGS. 4A through 4C, and the modified bow-tie configuration 70, as seen in FIGS. 4D through 4F, is novel in the art in assuring a fully open spout, and would prevent any possibility that the bow-tie knot may get snagged and prevent full opening of the discharge spout.

It is foreseen, that the closure feature of the bag with the drawstring housed within channel 54 may be modified. For example, when the cone shaped bottom as illustrated in FIG. 2 is formed in the construction of the bag, that may result in a pleat of material 60 being formed (as illustrated in phantom view in FIG. 1) which pleat 60 would be folded outwardly along the bottom portion of the bag. Therefore, when the pleat 60 of material is formed outwardly, there is formed a channel 64 within the pleat, which may house the drawstring 24 rather than the fabric channel 54 that would be formed on the bottom of the bag. However, in either embodiment, drawstring 24 is housed within a fabric channel and the drawstring 24 is not fully exposed along the underside of the bag when it is in the configuration as seen in FIG. 2.

Figure 7A:
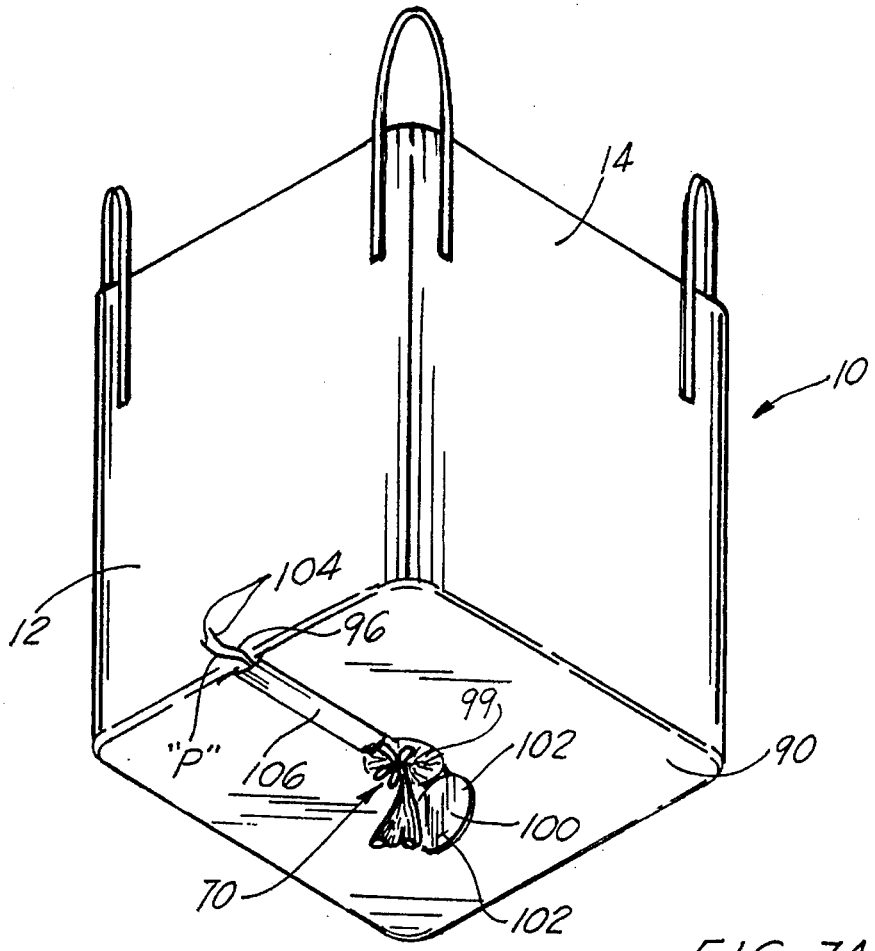
FIGS. 7A through 7D illustrate an alternate embodiment of a flat bottom bulk bag having a downspout tied off by the modified bow tie and the drawstring housed within a channel to be pulled from a point away from the bottom of the bag.
Figure 7B:
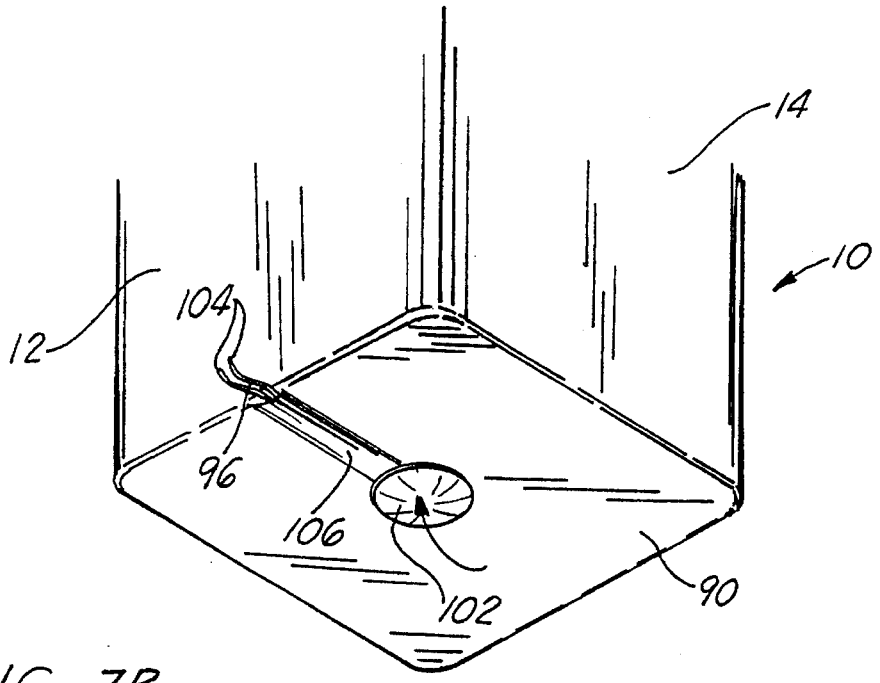
Figure 7C:
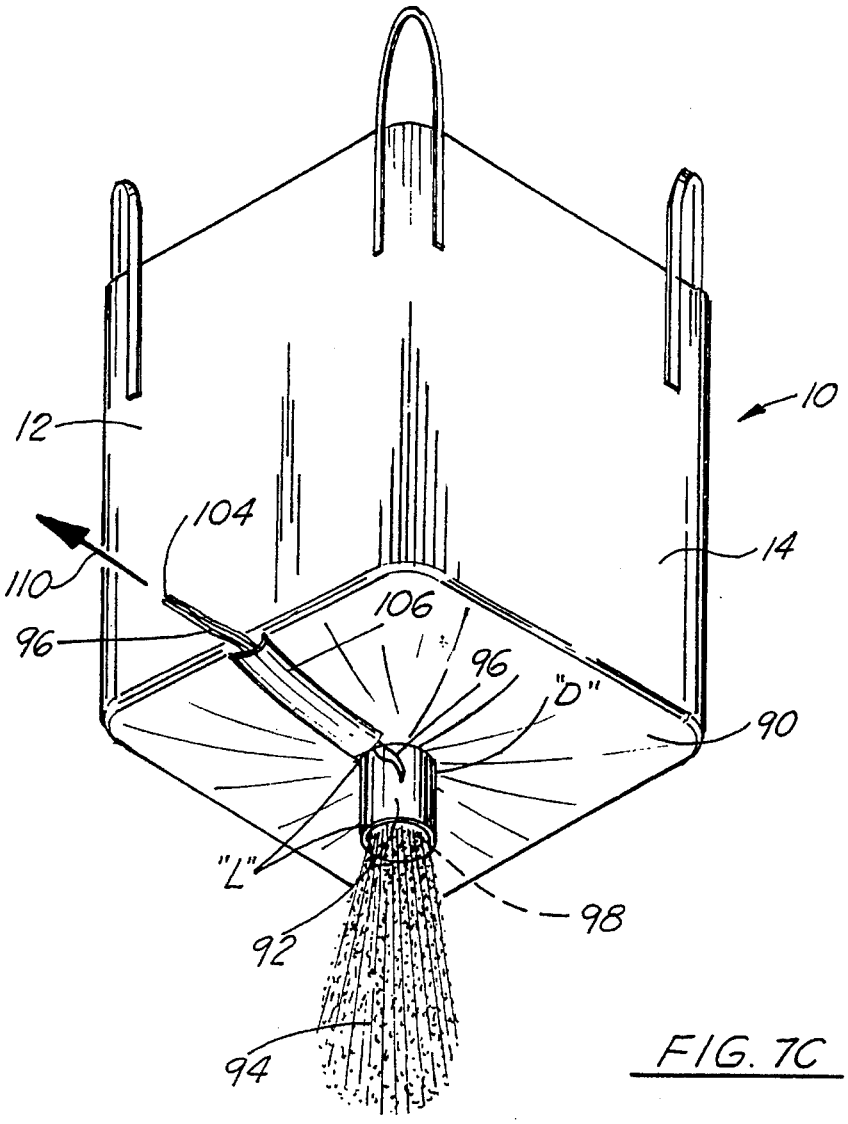

In a second embodiment as illustrated in FIGS. 7A through 7D, there is provided a bulk material transport bag 10 having a flat bottom 90 when the bottom is closed as seen in FIG. 7A or open as seen in FIG. 7C. There would be provided a discharge spout or tube 92 extending from the bottom 90 for discharging bulk material 94 contained within the bag, when the discharge tube 92 is open. In this embodiment, the bottom 90 of the bag would not be formed in the conical configuration as with the first embodiment, because this embodiment would be targeted for transporting bulk material which would not have a tendency to "bridge" across the opening. Such material would be pellets or other large bits of granular material, unlike fine powdered resins, or the like.

As illustrated the downspout 92 would provide a continuous fabric tube of material having a certain length "L" and having a tie or drawstring 96 at a point along its length so that when the spout 92 is tied off, the distance between the bottom 90 of the bag 10 and the tied drawstring 96 would be substantially equal to the radius of the discharge opening 98. Therefore, when the discharge spout 92 is tied off, it would form a substantially flat layer of fabric 99 across the closed discharge opening 98.

Figure 7D:
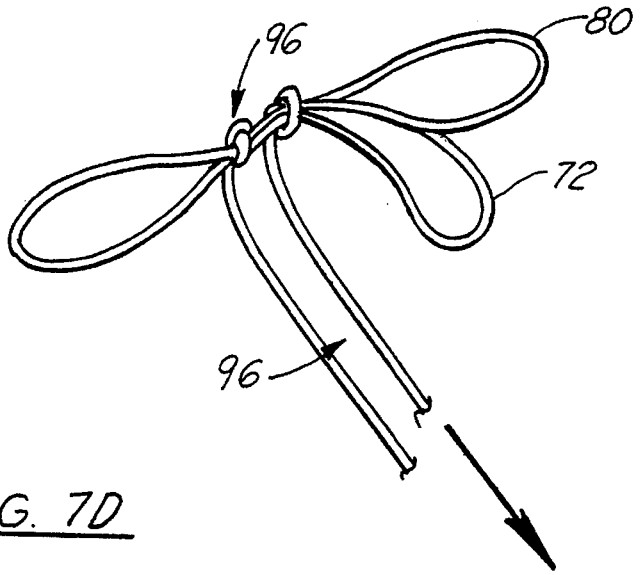

Following the closure of the spout 92, there is further provided a fabric flap 100 sewn along one edge to the bottom of the bag 10, the flap 100 having a dimension sufficient to completely cover the closed discharge spout 92, formed into the flat layer of fabric 99, when folded up against the bottom of the bag. The flap 100 would be held in place along its other three edges to the bottom of the bag 10 via velcro strips 102 or the like. This positioning of the flap 100 as seen in FIG. 7D would prevent inadvertent snagging of the closed spout 92 during transport.

As with the principal embodiment, the drawstring 96 would be tied off preferably by a bow tie knot, together with a half-hitch knot formed in at least one end of the tie string, or a second string with a loop for fully opening the bow tie knot. See FIGS. 4A through 4F which illustrate the two means of assuring that the bow tie knots formed in the drawstring 96 are completely untied when the drawstring 96 is pulled to open the discharge spout 92. It should be made clear that due to the tremendous weight of the product within the bag, when the drawstring 96 is released, the weight of the product will automatically release the flap 100 from its closed position, and the discharge spout 92 will drop fully open to allow the product 94 to pour easily from the bag 10.

As with the principal embodiment, the ends 104 of the drawstring 92 would be housed within a channel 106 formed along the bottom 90 of the bag 10, and extend out to a remote point "P" along the side wall 12 of the bag 10. Therefore, when the bag 10 is ready to be opened, and the product released, one must only pull the drawstrings 92 from point "P", and the bow tie closure 70 will fully release to allow the product to flow from the bag. This eliminates any fear of any material inadvertently releasing on a worker who may have to open the bag from beneath the bag.

Figure 8A:
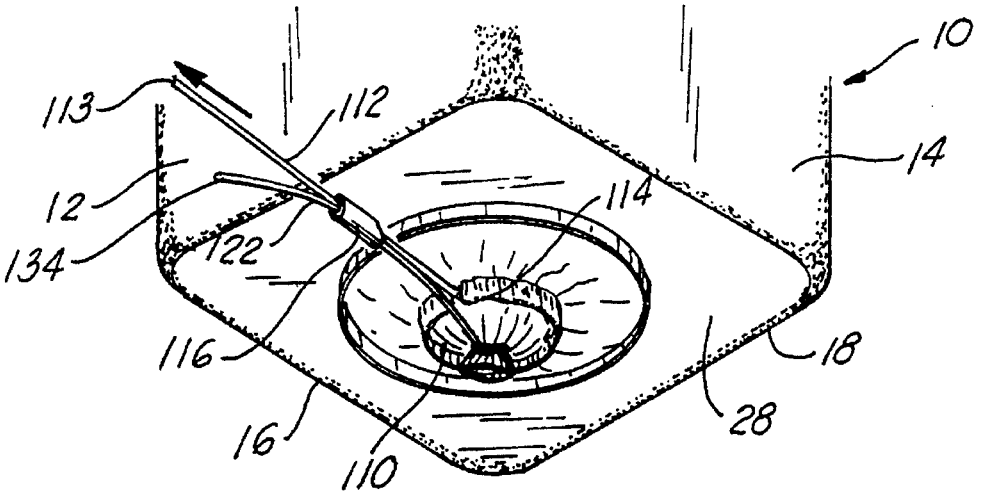
FIGS. 8A and 8B illustrate overall partial configurations of a flat bottom bulk bag with the discharge spout enclosure spout in the closed and opened positions respectively.
Figure 8B:
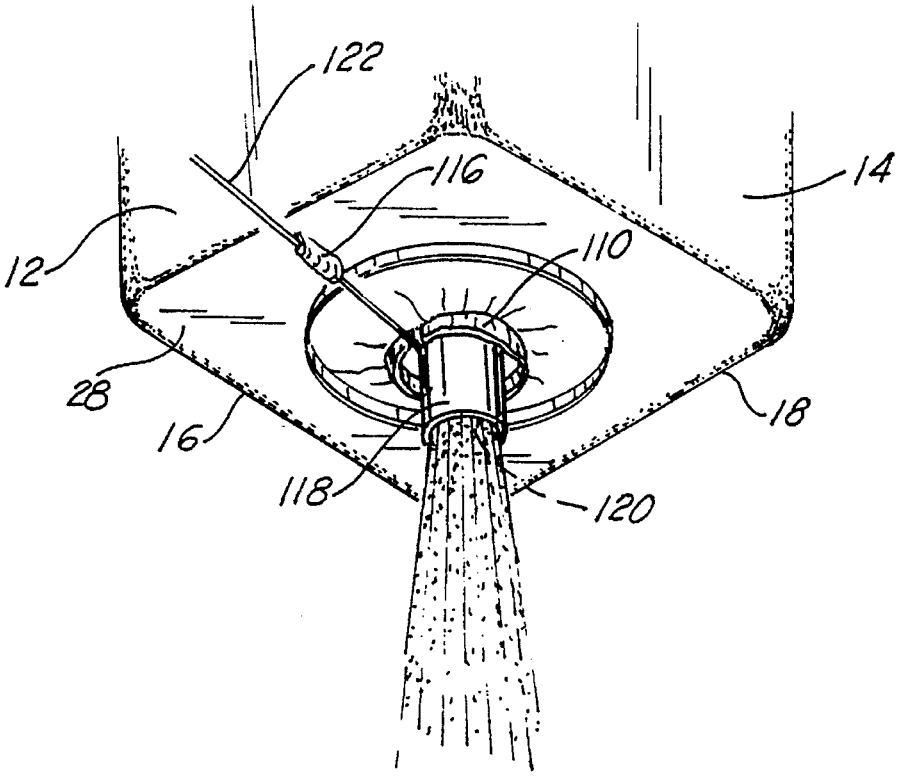

FIGS. 8A and 8B illustrate an additional embodiment of the present invention, wherein a bulk bag 10, having side walls 12, 14, 16, and 18, a flat bottom wall 28, first closure spout 110, tied off with a closure line 112, housed within channel 114 extending around the end of spout 110 to close it off. The ends 114 of line 110 extend outward along bottom wall 28 within an exit channel 116 and terminate along side 12 of the bag. Housed within closure spout 110, would be the discharge spout 118, having a discharge spout opening 120, with the discharge spout 118 likewise tied off and stuffed within closure spout 110, as seen in FIG. 8A. As with the closure spout 110, the discharge spout 118 would also include a drawstring 120, extending through channel 116, and likewise serving as a means for opening discharge spout 118 from the side wall 12 of bag 10 as illustrated in FIG. 8A.

Figure 9A:
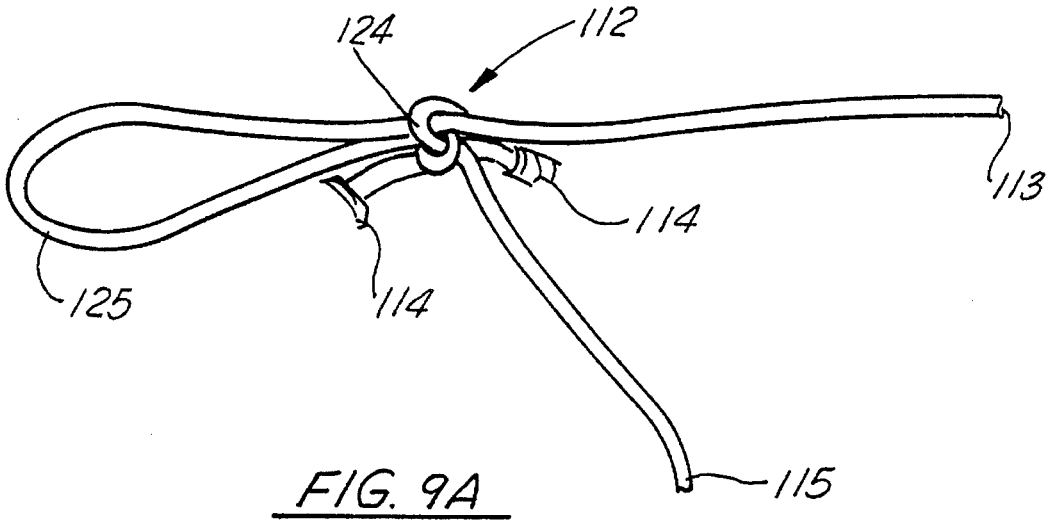
FIGS. 9A through 9C illustrate the configuration of the closure spout line as tied and released during closing and opening of the closure spout.
Figure 9B:
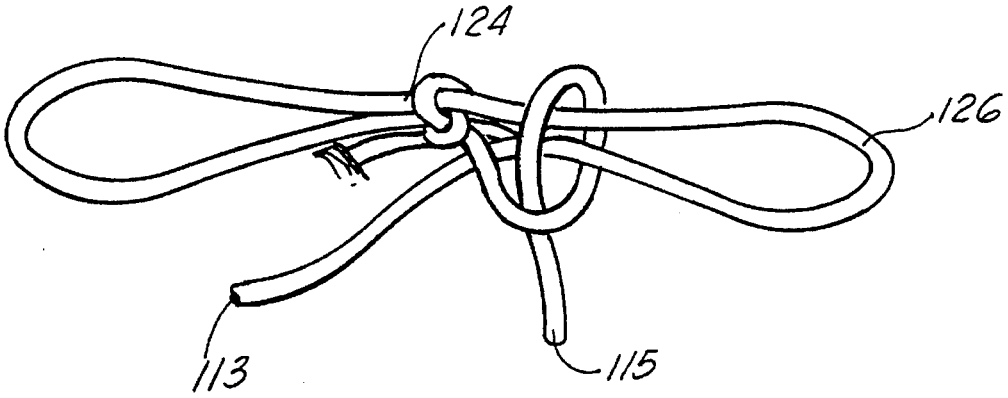
Figure 9C:
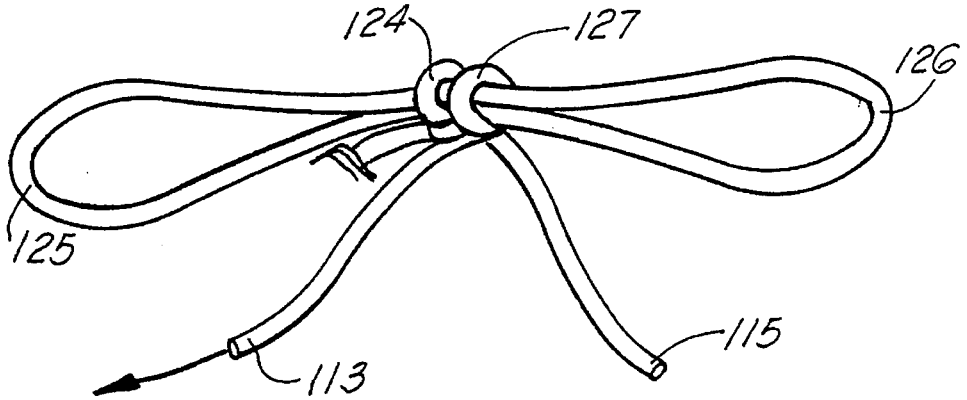

Turning now to the means by which the closure spout 110 is tied off, reference is made to FIGS. 9A through 9C. As illustrated, the discharge spout 118 has been tied off, in a manner as will be explained further, and has been stuffed into the interior of bag 10. After that is accomplished, the closure line 112 in the channel 114 of closure spout 110 is pulled tight to close off the closure spout 110 to form the closure as illustrated. Once this is accomplished, the two ends 113, 115 of the closure line 112 are extending out from the channel 114 formed in the closure spout for tying it off. In the tying off of line 112, first, there is formed a half knot 124 pulled tight against the closure spout 110, forming first half-bow 125. One end 113 of the closure line 112 is then formed into a half bow 126, and the second end 115 of the line 112 is hitched around it so that a second half-knot 127 is formed and the second half-bow 126 is completed. Following that procedure, end 113 of line 112 which has been wrapped around the half bow 126, is then threaded through the channel 116, and extends out along wall 12 of the bag as seen in FIG. 8A. Therefore, after the bag has been filled, when one wishes to empty the contents, one simply pulls on the end 113 of line 112 which easily unhitches the first half bow 126. After the first half bow 126 has been unhitched, the second half bow 125 is then unhitched by a continuous pulling of the end 113 of line 112. In order to facilitate the complete opening of the closure spout 110, the line 112 is continued to be pulled until it is completely out of the channel 114 of the closure spout 110 which allows the spout 110 to fully open as illustrated in FIG. 8B. This type of a double half bow tie on the closure spout 110 is an important tie in view of the fact that it assures that the tying of line 112 will not restrict the spout 110 from completely opening due to the weight of the bulk material within the bag 110.

Figure 10A:
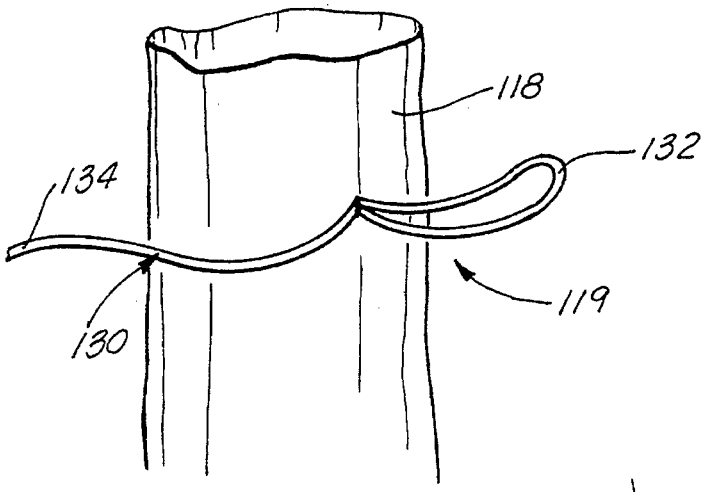
FIGS. 10A through 10D illustrate views of the tying off of the discharge spout in a flat bottom bag.
Figure 10B:
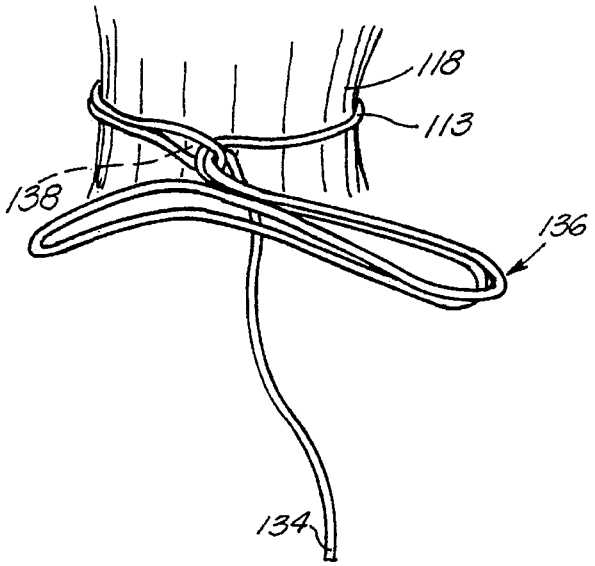
Figure 10C:
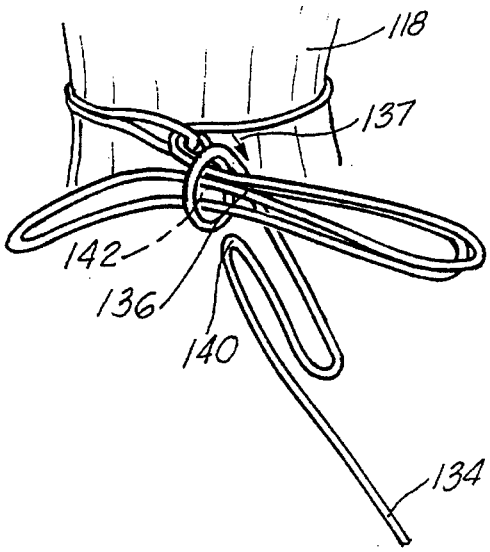
Figure 10D:
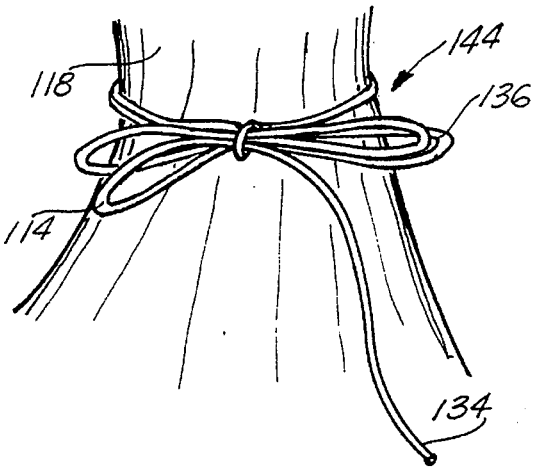

Turning now to the means of tying off the discharge spout 118, reference is made to FIGS. 10A through 10D. As noted in FIG. 10A, the tying means 119 of discharge spout 118, is formed by a line 130, having a first loop 132, sewed into the wall of the spout 118, with the second end 134 of the line 130 extending therefrom. When the discharge spout 118 is closed off (FIG. 10B), the second end 134 of the line 130 is wrapped around the discharge spout 118 and doubled up to form a second loop 136, which is then threaded through the opening 138 within first loop 132. After it is threaded therethrough, the second end 134 of the line, is then wrapped around the second loop 136 (arrow 137), as seen in FIG. 10C, and is then formed into a third loop 140, which is then threaded through the opening 142 in the wraparound, and formed into what resembles a double bow tie 144 as seen in FIG. 10D. The second end 134 is then threaded through the same channel 116 attached to the bottom wall 28 of the bag 10, and extends out of the side wall 12 of bag 10, as illustrated in FIG. 8A. Therefore, once the closure spout 110 has been opened in the manner as was described earlier, the second end 134 of the discharge tie line 130 is then pulled, and the double bow tie 144 is released in the manner in the reversal order as noted in FIGS. 10A through 10D, and the line simply hangs from its point of attachment on the wall of the discharge spout 118.

Through this means of securing both the closure spout and the discharge spout on the flat wall of bulk bag 10, the manner of the side entry release as illustrated in FIGS. 8A and 8B, is assured that both the discharge and the closure spout will be fully opened upon release of the respective lines as previously described.

The following table lists the part numbers and part descriptions as used herein and in the drawings attached hereto.

Glossary of Terms bulk bag 10
side walls 12, 14, 16, 18
bottom discharge portion 20
bulk storage space 21
bulk material 22
drawstring 24
discharge opening 26
bottom wall 28
conical configuration 25
channel 30
flat configuration 29
skirt 31
iris closure 27
bow tie 34
ends 33, 35
safety loop 37
second end 39
knot 41
loops 50
fabric channel 54
distal end 56
pleat 60
channel 64
bow-tie 70
loop 72, 74
loop base 73
drawstring ends 76, 78
arrow 79
third "half-hitch" loop 80
knot 84
arrow 86
flat bottom 90
discharge spout or tube 92
bulk material 94
drawstring 96
discharge opening 98
fabric 99
fabric flap 100
velcro strips 102
ends 104
channel 106
length "L"
point "P"
closure spout 110
closure line 112
first end 113
channel 114
second end 115
exit channel 116
discharge spout 118
discharge spout opening 120 iris closure 122 half knots 124, 127 half bows 125, 126 line 130 first loop 132 second end 134 second loop 136 arrow 137 opening 138 third loop 140 opening 142 double bow tie 144

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is

1. A bulk material transport bag, comprising:

a) a bulk containing space, defined by at least four side walls and a bottom wall, having a discharge opening formed therein;

b) means associated with the bottom wall to form the bottom wall from a flat configuration when the discharge opening is closed, to a conical configuration when the discharge opening is open;

c) a drawstring for opening the discharge opening from a remote point near an outer edge of the bottom wall, so that the bottom wall is configured to the conical configuration, and bulk material flows from the opening; and d) a string having first and second ends, the string forming a loop on one end and having a second end extending to the remote point formed around a drawstring near the outer edge of the bottom wall, the loop formed around the drawstring, so that when the drawstring is pulled, the loop is likewise pulled to move any snag in the drawstring down the length of the drawstring, in order to provide additional drawstring for allowing full opening of the conical discharge of the bag from the remote point.

2. The bulk material transport bag in claim 1, further comprising means, associated with the means for opening the discharge opening from a remote point, for providing full opening of a conical bottom in the event the opening means is prevented from fully opening.

3. The bag in claim 2, wherein the discharge opening is closed by a drawstring which pulls fabric of the conical bottom toward the center of the discharge opening and forms the flat bottom bag when the discharge opening is closed with the drawstring.

4. The bag in claim 1, wherein the means for opening the discharge opening comprises a drawstring housed within a channel around the opening and extending to the remote point, the ends of the drawstring tied in a bow tie configuration, so that release of the bow tie from pulling the drawstring from the remote point results in full opening of the discharge opening.

5. The bag in claim 1, further comprising a bulk material inlet opening for filling the bag with bulk material.

6. The bag in claim 1, wherein a portion of the bottom wall which defines a conical bottom to move the material out of the discharge opening and eliminate the need for a discharge spout extending from the bottom of the bag.

7. The bag in claim 1, wherein the drawstring further comprises a bow-tie formed at the end of the drawstring, and a single "half-hitch" loop formed with one end tie-end of the bow-tie, so that the force imparted by the weight of the material within the bulk bag would be imparted primarily on the "half-hitch" knot, which, when released, would allow the bow-tie to fully release.

8. A bulk material transport bag, comprising:

a) at least four side walls and a bottom wall, defining a bulk material storage space therewithin, the bottom wall having a discharge opening formed therein;

b) means associated with the bottom wall to form the bottom wall from a flat configuration when the discharge opening is closed, to a conical configuration when the discharge opening is open;

c) drawstring means threaded within a channel around the wall of the discharge opening for closing off the discharge opening for the bag to receive bulk material in the bag, and for opening the discharge opening from a remote point near an outer edge of the bottom wall, when the drawstring is pulled; and d) a second string, forming a loop on one end, and a second end extending to the remote point near the outer edge of the bottom wall, the loop formed around the drawstring, so that when the drawstring is pulled, the loop is likewise pulled to move any snag in the drawstring down the length of the drawstring, to provide additional drawstring for allowing full opening of the discharge opening of the bag.

9. The bag in claim 8, wherein the drawstring is housed within a fabric channel extending from a iris closure, so that the ends of the drawstring may be pulled from a remote point along the side wall of the bag.

10. The bag in claim 8, wherein the drawstring maintains the discharge opening closed by tying a "bow tie" knot in the drawstring between the closed discharge opening and the fabric channel.

11. The bag in claim 8, wherein the bottom wall further comprises a conical portion to allow the material to flow out of the discharge opening and eliminate the need for a discharge spout extending from the bottom of the bag.

12. The bag in claim 8, wherein the channel containing the drawstring is positioned along the length of the conical wall of the discharge end of the bag, so that the length of that portion of the conical wall between the channel and the bottom of the bag is at least equal to than the radius of the bottom of the bag.

13. The bag in claim 9, wherein the channel further comprising a series of spaced apart loops along the wall of the conical wall of the discharge end of the bag for housing the drawstring.

14. A bulk material transport bag, comprising:

a) a bulk containing space, defined by at least four side walls and a bottom wall, having a discharge opening formed therein;

b) a discharge spout having a wall portion extending from the discharge opening in the bottom wall of the bag;

c) a closure spout surrounding the discharge opening, having a length equal to the radius of the opening, so that upon closing the closure spout, the spout forms an iris closure over the discharge opening;

d) a first drawstring positioned within a channel on the closure spout for drawing the closure spout closed to form the iris closure on the bottom of the bag;

e) a second string positioned around the length of the discharge spout for closing off the discharge spout;

f) means for opening the closure spout from a remote point along the sidewall of the bag, said means further comprising a double half-bow tie means maintaining the iris closure closed until an end of the drawstring is pulled from the remote point, and the closure spout forms a complete opening; and g) means for discharging the materials from the bag when the second drawstring is pulled from the remote point along the sidewall, so that bulk material flows through the opening; said means further comprising a tie means, comprising a loop attached to the wall portion of the discharge spout, a first end of the tie means threaded through the loop and doubled back upon itself, and formed into a bow for easy release from the sidewall of the bag from the remote point.

15. The transport bag in claim 14, wherein the drawstring can be pulled completely from the channel formed on the closure spout to enable full opening of the spout during emptying of the bag.

16. In a bulk material transport bag, having a bulk containing space, defined by at least four side walls and a bottom wall, having a circular discharge opening formed therein; a discharge spout extending from the circular discharge opening in the bottom wall of the bag; a closure spout surrounding the discharge opening, having a length equal to a radius of the circular discharge opening, so that upon closing the closure spout, the spout forms an iris closure over the discharge opening; a first drawstring positioned within a channel on the closure spout for drawing the closure spout closed to form the iris closure on the bottom of the bag; a second string positioned around the circumference of the discharge spout for closing off the discharge spout; the improvement comprising:

a) a loop formed on one end of the second string, and a second end of the string extending to the remote point near the outer edge of the bottom wall, the loop formed around the drawstring, so that when the drawstring is pulled, the loop is likewise pulled to move any snag in the drawstring down the length of the drawstring, in order to provide additional drawstring for allowing full opening of the conical discharge of the bag from the remote point.

* * * * *